US008740629B1

(12) United States Patent
Hall et al.

(10) Patent No.: US 8,740,629 B1
(45) Date of Patent: Jun. 3, 2014

(54) HEADER ASSEMBLY

(71) Applicant: Tyco Electronics Corporation, Berwyn, PA (US)

(72) Inventors: John Wesley Hall, Harrisburg, PA (US); Raymond John DeMarchis, Jr., Enola, PA (US); Douglas John Hardy, Middletown, PA (US); Ronald Louis Marion, Yadkinville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/689,291

(22) Filed: Nov. 29, 2012

(51) Int. Cl.
*H01R 12/00* (2006.01)

(52) U.S. Cl.
USPC ..... 439/63; 439/680

(58) Field of Classification Search
USPC ..... 439/79, 63, 188, 944, 934, 680, 681
See application file for complete search history.

(56) References Cited

U.S. PATENT DOCUMENTS

| | | | | |
|---|---|---|---|---|
| 4,111,514 | A * | 9/1978 | Brishka et al. | 439/680 |
| 6,152,743 | A * | 11/2000 | Fox | 439/63 |
| 6,790,047 | B2 * | 9/2004 | Togashi | 439/63 |
| 7,101,189 | B1 | 9/2006 | Huss et al. | |
| 7,563,103 | B1 * | 7/2009 | Hall et al. | 439/63 |
| 7,682,205 | B2 * | 3/2010 | Hall et al. | 439/752 |
| 7,794,277 | B1 | 9/2010 | Peng | |
| 2013/0109228 | A1 * | 5/2013 | Sykes et al. | 439/578 |

FOREIGN PATENT DOCUMENTS

EP 1 453 151 A2 9/2004

OTHER PUBLICATIONS

Drawing No. C-2203006 Male Assembly, 1 Position, 6 O'clock Edge Mount, PCB, Fakra, Rev. 5, Jul. 30, 2012, 1 pg, TE Connectivity.
Drawing No. C-1670861, Fakra PCB 1Pos, Jack, Right Angled, Rev. D5, Oct. 20, 2011, 3 pgs, TE Connectivity.
International Search Report, International Application No. PCT/US2013/070868, International Filing Date, Nov. 20, 2013.

* cited by examiner

*Primary Examiner* — Neil Abrams
*Assistant Examiner* — Phuonghi T Nguyen

(57) ABSTRACT

A header assembly includes a conductive outer housing holding a center contact and a dielectric body. The outer housing has a rear shell and an outer contact extending forward from the rear shell. The outer contact has a catch extending therefrom positioned forward of the rear shell. The header assembly includes a nose cone coupled to the outer contact. The nose cone is manufactured from a plastic material. The nose cone surrounds the outer contact. The nose cone has keying ribs along an exterior thereof. The nose cone has a latch engaging the catch to secure the nose cone to the outer housing.

20 Claims, 6 Drawing Sheets

HEADER ASSEMBLY

BACKGROUND OF THE INVENTION

The subject matter herein relates generally to header assemblies.

Radio frequency (RF) coaxial connector assemblies have been used for numerous automotive applications, such as global positioning systems (GPS), car radios, mobile phones, air bag systems, and multimedia devices. Some connector assemblies are coaxial cable assemblies terminated to ends of coaxial cables. Coaxial cables typically consist of an outer conductor, an inner conductor, a dielectric, and a jacket or outer insulation. The outer conductor and the inner conductor of the cable electrically interface with corresponding inner and outer contacts of the connector, which may be a male or a female connector. Other connector assemblies are terminated to a circuit board rather than a cable. For interfacing with coaxial cable assemblies, such board mounted assemblies include a coaxial interface defined by a center contact and an outer contact surrounding the center contact. Both contacts are terminated to the circuit board.

In order to standardize various types of connectors and thereby avoid confusion, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. The keying and color identifying features of a FAKRA connector are typically on an outer housing. Like male keys can only be connected to like female keyways in FAKRA connector assemblies. Secure positioning and locking of connector housings is facilitated by way of a FAKRA defined catch on the male housing and a cooperating latch on the female housing.

Typical product families of FAKRA connectors include numerous different outer housings, each having a different mold or die or tool inserts to form the particular arrangement of keys. Manufacturing many different molds or dies is expensive. Additionally, requiring customers to carry a different part for each desired keying configuration causes additional expense to the customer in terms of inventory and warehousing of inventory.

A need remains for a connector assembly that is part of a product family that reduces part numbers.

BRIEF DESCRIPTION OF THE INVENTION

In one embodiment, a header assembly is provided that includes a center contact, a dielectric body surrounding the center contact, and an outer housing holding the center contact and the dielectric body. The outer housing is conductive and provides electrical shielding for the center contact. The outer housing has a rear shell and an outer contact extending forward from the rear shell. The outer contact has a catch extending therefrom positioned forward of the rear shell. The outer contact receives the dielectric body and the center contact. A nose cone is coupled to the outer contact. The nose cone is manufactured from a plastic material. The nose cone surrounds the outer contact. The nose cone has keying ribs and color identification along an exterior thereof. The nose cone has a latch engaging the catch to secure the nose cone to the outer housing.

Optionally, the nose cone may be removably coupled to the outer contact. The nose cone may be variably positionable on the outer contact at at least two different radial positions. The catch may be a primary catch and the outer contact may have a secondary catch opposite primary catch. The nose cone may be coupled to either the primary catch or the secondary catch to change an orientation of the keying ribs relative to the outer housing.

Optionally, the outer housing may include anti-rotation rails extending along an exterior of the outer contact. The nose cone may include anti-rotation slots receiving the anti-rotation rails when the nose cone is coupled to the outer contact. The anti-rotation rails and anti-rotation slots may hold a radial position of the nose cone relative to the outer contact.

Optionally, the nose cone may include a pocket opposite the latch. The nose cone may be positionable on the outer contact in different orientations. In a first orientation of the nose cone, the latch may engage the catch. In a second orientation of the nose cone, the pocket may receive the catch.

In another embodiment, a header assembly is provided including a center contact, a dielectric body surrounding the center contact and an outer housing holding the center contact and the dielectric body. The outer housing is conductive and provides electrical shielding for the center contact. The outer housing has a rear shell and an outer contact extending forward from the rear shell. The outer contact receives the dielectric body and the center contact. The outer contact has a primary catch extending therefrom positioned forward of the rear shell. The outer contact has a secondary catch extending therefrom positioned forward of the rear shell and located 180° from the primary catch. A nose cone is coupled to the outer contact. The nose cone is manufactured from a plastic material. The nose cone surrounds the outer contact. The nose cone has keying ribs and color identification along an exterior thereof. The nose cone has a latch and a pocket located 180° from the latch. The nose cone is positioned in one of a primary orientation and a secondary orientation. In the primary orientation, the latch engages the primary catch to secure the nose cone to the outer housing with the pocket receiving the secondary catch. In the secondary orientation, the latch engages the secondary catch to secure the nose cone to the outer housing with the pocket receiving the primary catch.

In another embodiment, a header assembly kit is provided including a center contact, a dielectric body configured to receive the center contact, a first outer housing configured to receive the dielectric body, a second outer housing configured to receive the dielectric body, and a nose cone configured to be coupled to either the first outer contact or the second outer contact. The first outer housing is conductive to provide electrical shielding for the center contact. The first outer housing has a first rear shell and a first outer contact extending forward from the first rear shell. The first outer contact has a first catch extending therefrom positioned forward of the first rear shell. The first catch is located at a first radial position along the first outer contact. The second outer housing is conductive to provide electrical shielding for the center contact. The second outer housing has a second rear shell and a second outer contact extending forward from the second rear shell. The second outer contact has a second catch extending therefrom positioned forward of the second rear shell. The second catch is located at a second radial position along the second outer contact. The second radial position is different than the first radial position. The nose cone is manufactured from a plastic material. The nose cone has keying ribs along an exterior thereof. The nose cone has a latch configured to engage the first catch when the nose cone is coupled to the first outer contact and configured to engage the second catch when the nose cone is coupled to the second outer contact. The orientation of the keying ribs is different when the nose cone is coupled to the first outer contact as compared to when the nose cone is coupled to the second outer contact.

DETAILED DESCRIPTION OF THE INVENTION

Figure 1:
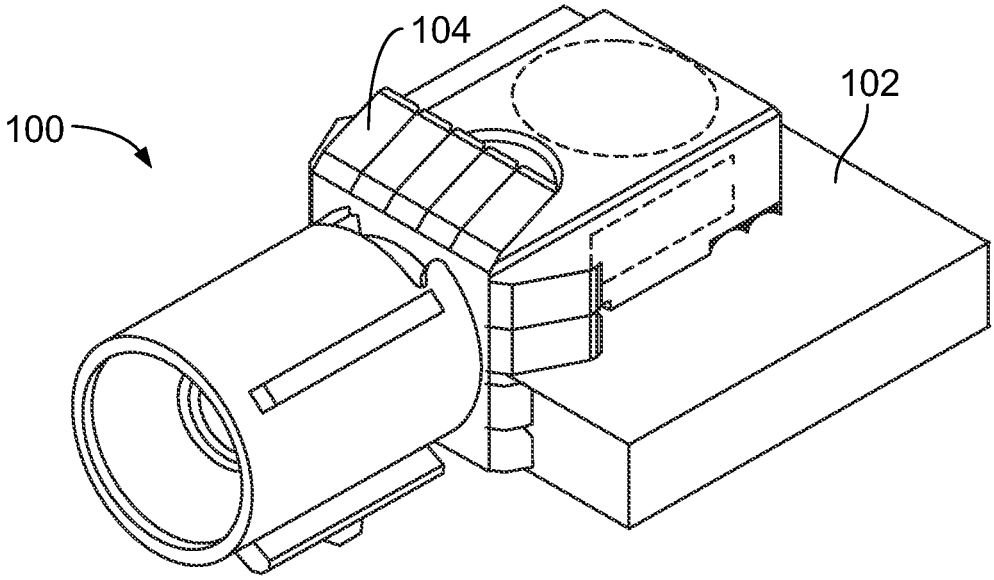
FIG. 1 is a front perspective view of a header assembly formed in accordance with an exemplary embodiment.

FIG. 1 is a front perspective view of a header assembly 100 formed in accordance with an exemplary embodiment. The header assembly 100 may be mounted in a device, such as a radio, having a casing that houses components of a communication system. The header assembly 100 may pass through an opening in the casing of the device for mating with a corresponding connector assembly (not shown).

The header assembly 100 is mounted to a circuit board 102, which may form part of a communication system, such as for an automotive vehicle. For example, the communication system may be used in an automotive application, such as a global positioning system (GPS), car radio, mobile phone, air bag system, multimedia device system, and the like. The system may have use in other types of applications such as aeronautic applications, marine applications, military applications, industrial applications and the like. The circuit board 102 may form part of an antenna. The circuit board 102 may form part of a radio frequency (RF) system.

In the illustrated embodiment, the header assembly 100 constitutes a male assembly that is configured to be mated with a corresponding female assembly (not shown). In an exemplary embodiment, the header assembly 100 is a standardized connector, such as a FAKRA standardized connector. The header assembly 100 has features designed according to desired FAKRA specifications. For example, the header assembly 100 may have certain keying configurations.

In an exemplary embodiment, the header assembly 100 is part of a product family of FAKRA connectors. The product family includes many different keying configurations. The design of the header assembly 100 reduces the number of parts needed to complete the product family. For example, the header assembly 100 allows components to be mixed and matched and coupled together in different ways to achieve different keying combinations without the need for one particular part for each keying configuration. The overall cost of manufacturing the product family is reduced by the robust header assembly design. The total parts needed on hand for a customer is reduced with the header assembly design 100.

The header assembly 100 includes a shield member 104 attached thereto. Optionally, the shield member 104 may be used to provide shielding at the opening through the casing of the device. The shield member 104 is used to electrically connect the header assembly 100 to the casing of the device. For example, the shield member 104 may create a direct electrical path between the casing and the header assembly 100.

Figure 2:
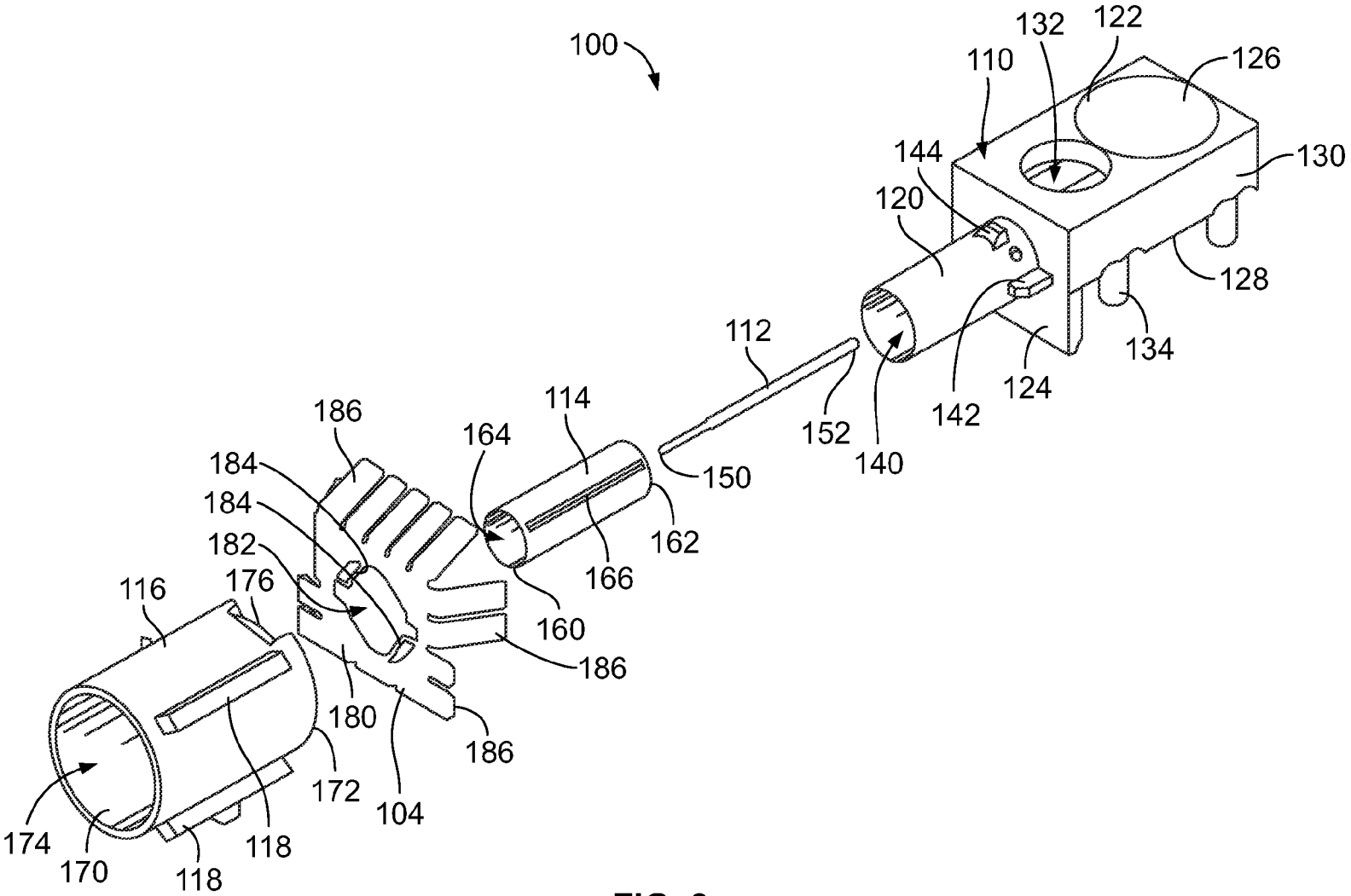
FIG. 2 is an exploded perspective view of the header assembly.

FIG. 2 is an exploded perspective view of the header assembly 100. The header assembly 100 includes an outer housing 110, a center contact 112, a dielectric body 114, the shield member 104 and a nose cone 116. The center contact 112 and dielectric body 114 are received in the outer housing 110. The shield member 104 is coupled to the outer housing 110. The nose cone 116 is coupled to a front of the outer housing 110 to define a mating interface for the mating connector (not shown). The nose cone 116 receives and surrounds the outer contact 120.

In an exemplary embodiment, the mating end of the header assembly 100 defines a FAKRA compliant connector. The nose cone 116 provides an interface keyed according to FAKRA specifications. For example, the nose cone 116 includes one or more keying ribs 118 on an exterior surface thereof. The nose cone 116 may have color identification. The size, shape and/orientation of the keying ribs 118 may be used to define the different FAKRA interfaces. Optionally, different nose cones 116 having different arrangements of keying ribs 118 may be provided within the product family. The different nose cones 116 may be coupled to the outer housing 110 to define different keying configurations. In an exemplary embodiment, as described in further detail below, the nose cones 116 may be coupled to the outer housing 110 in different orientations to define different keying configurations. For example, in one orientation, the keying ribs 118 may be provided on a top of the header assembly 100, but in another orientation, the nose cone 116 may be rotated 180° such that the keying ribs 118 are provided on the bottom of the header assembly 100. Optionally, other outer housings may be provided that allow the nose cone 116 to be positioned at other radial orientations, such as with the keying ribs 118 facing to the right or to the left. In an alternative embodiment, the header assembly 100 may be designed to different standards or to mate with a different type of mating connector.

The outer housing 110 has an outer contact 120 and a rear shell 122. The outer housing 110 is manufactured from a conductive material, such as a metal material. In an exemplary embodiment, the outer housing 110 is die cast, however the outer housing 110 may be manufactured by other processes in alternative embodiments, such as stamping and forming. The outer housing 110 is configured to be electrically grounded, such as to the circuit board 102 (shown in FIG. 1), to the mating connector and to the casing of the device via the shielding member 104. The outer housing 110 provides electrical shielding for the center contact 112 along an entire length of the center contact 112.

The rear shell 122 is generally box-shaped, however the rear shell 122 may have other shapes in alternative embodiments. In the illustrated embodiment, the rear shell 122 includes a front wall 124. The rear shell 122 includes a top wall 126 opposite an open bottom 128. The rear shell 122 includes side walls 130 extending rearward from the front wall 124. The walls of the rear shell 122 define a receptacle 132 that receives the center contact 112.

The rear shell 122 provides electrical shielding around the receptacle 132 and the center contact 112. The open bottom 128 of the rear shell 122 may be mounted directly to the circuit board 102. The center contact 112 extends into the rear shell 122 and is exposed along the open bottom 128 for termination to the circuit board 102. For example, the center contact 112 may be surface mounted to the circuit board 102, such as by soldering to the circuit board 102.

The rear shell 122 includes mounting posts 134 extending from the bottom 128. The mounting posts 134 may be loaded into corresponding openings in the circuit board 102 to locate the outer housing 110 relative to the circuit board 102. The mounting posts 134 may be electrically connected to the circuit board 102. For example, the openings in the circuit board 102 may be plated and the mounting posts 134 may be soldered therein. Other types of features may be provided in alternative embodiments to locate and/or secure the outer housing 110 to the circuit board.

In an alternative embodiment, rather than being a right angle header assembly, the header assembly may be a vertical header assembly having a bottom opposite the mating end. The center contact may extend perpendicular to the circuit board in a vertical direction and may be terminated by a press fit. In other alternative embodiments, the header assembly may be cable mounted rather than being mounted to the circuit board.

The outer contact 120 extends forward from the front wall 124 of the rear shell 122. Optionally, the outer contact 120 may be cylindrical in shape. The outer contact 120 includes a bore 140 that receives the dielectric body 114. The dielectric body 114 is held within the bore 140 of the outer contact 120 and surrounds the center contact 112 to provide electrical shielding for the center contact 112.

In an exemplary embodiment, the outer contact 120 includes anti-rotation rails 142 proximate to the front wall 124 of the rear shell 122. The anti-rotation rails 142 are used to hold the nose cone 116 in position on the outer housing 110. The anti-rotation rails 142 prevent rotation of the nose cone 116 relative to the outer housing 110. In the illustrated embodiment, the anti-rotation rails 142 are provided on opposite sides of the outer contact 120 at a 3 o'clock position and a 9 o'clock position. Other positions are possible in alternative embodiments.

In an exemplary embodiment, the outer contact 120 includes a primary catch 144 proximate to the front wall 124 of the rear shell 122. The outer contact 120 includes a secondary catch 146 (shown in FIG. 4) generally opposite the primary catch 144. In the illustrated embodiment, the primary catch 144 is positioned at a 12 o'clock position and the secondary catch 146 is positioned at a 6 o'clock position. Other positions are possible in alternative embodiments.

The nose cone 116 is configured to be coupled to the outer housing 110 using the primary catch 144 or the secondary catch 146. For example, the nose cone 116 may be coupled to the outer housing 110 in a first orientation by securing the nose cone to the primary catch 144. Alternatively, the nose cone 116 may be coupled to the outer housing 110 in a second orientation by rotating the nose cone 116 180° and securing the nose cone 116 to the secondary catch 146. Two different keying configurations may thus be achieved with the same outer housing 110 and nose cone 116.

The center contact 112 extends between a mating end 150 and a terminating end 152. In the illustrated embodiment, the mating end 150 constitutes a pin, however other types of mating interfaces may be provided in alternative embodiments. For example, the mating end 150 may be a socket, a blade, deflectable spring beams, or another type of mating interface. The terminating end 152 is configured to be terminated to the circuit board 102. Optionally, the terminated end 152 may be surface mounted to the circuit board 102, such as by using a solder ball, a deflectable spring or another type of interface. In an alternative embodiment, the terminating end 152 may include a straight pin or a compliant pin, such as an eye-of-the-needle pin, for through-hole mounting to a corresponding via of the circuit board 102.

The dielectric body 114 is manufactured from a non-conductive material, such as a plastic material. The dielectric body 114 may be manufactured from an injection molding process. The dielectric body 114 extends between a front 160 and a rear 162. In an exemplary embodiment, the dielectric body 114 is cylindrical in shape. The dielectric body 114 includes a bore 164 extending between the front 160 and the rear 162. The bore 164 receives the center contact therein.

In an exemplary embodiment, the dielectric body 114 includes one or more ribs 166 extending longitudinally along an exterior surface of the dielectric body 114. The ribs 166 may be used to position the dielectric body 114 in the bore 140 of the outer contact 120. The ribs 166 may prevent rotation of the dielectric body 114 within the outer contact 120.

The nose cone 116 is manufactured from a non-conductive material, such as a plastic material. The nose cone 116 may be manufactured by an injection molding processing. The nose cone 116 is generally cylindrical in shape and extends between a front 170 and a rear 172. The keying ribs 118 extend along an exterior surface of the nose cone 116. The nose cone 116 includes a bore 174 extending between the front 170 and the rear 172. The nose cone 116 is configured to be loaded onto the front of the outer housing 110, such that the outer contact 120 is received in the bore 174.

The nose cone 116 includes a latch 176 used to secure the nose cone 116 to the outer housing 110. The latch 176 is configured to engage one of the catches 144, 146 to secure the nose cone 116 to the outer housing 110. For example, in a first orientation, the latch 176 engages the primary catch 144, while in a second orientation, the latch 176 engages the secondary latch 146. The orientation of the keying ribs 118 relative to the outer housing 110 is different in the first orientation as compared to the second orientation.

The shield member 104 is configured to be coupled to the outer housing 110 such that the shield member 104 provides shielding for the opening in the casing of the device. The shield member 104 may form an electrically conductive path between the casing and the outer housing 110. The shield member 104 may form an electrically conducted path between the circuit board 102 and the casing. The shield member 104 is configured to be coupled to the outer housing 110 generally between the rear shell 122 and the nose cone 116. The nose cone 116 may hold the shield member 104 on the outer housing 110. The nose cone 116 may press the shield member 104 against the rear shell 122 to ensure electrical contact between the shield member 104 and the outer housing 110. The shield member 104 is coupled to the outer contact 120 such that the shield member 104 is electrically and mechanically connected to the outer contact 120.

The shield member 104 is manufactured from a conductive material, such as a metal material. The shield member 104 may be manufactured by a stamping and forming process. The shield member 104 includes a plate 180 having an opening 182 therethrough with spring contacts 184 extending into the opening 182. The spring contacts 184 engage the outer contact 120 to mechanically and electrically connect the shield member 104 to the outer contact 120. A plurality of spring fingers 186 extend from the plate 180. The spring fingers 186 are configured to be spring biased against the casing when the header assembly 100 is coupled to the casing.

Figure 3:
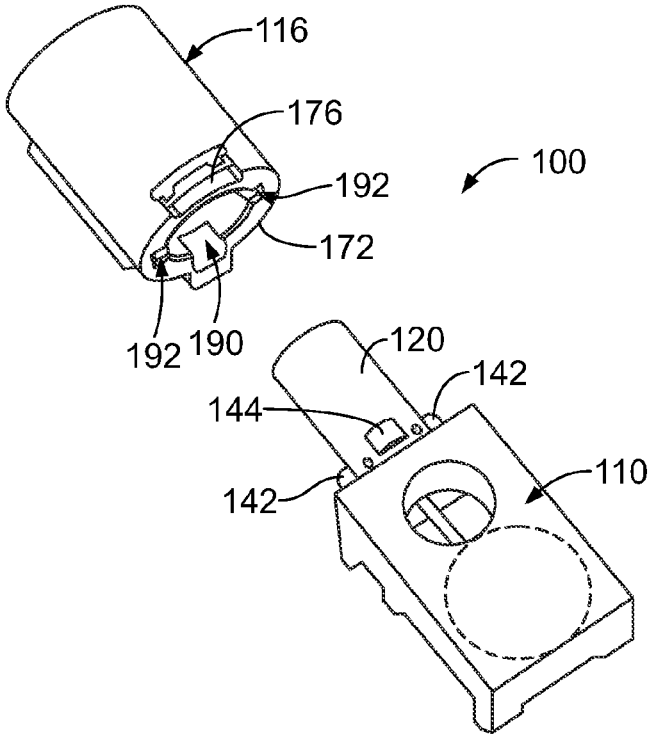
FIG. 3 is a top perspective view of the header assembly showing a nose cone poised for coupling to an outer housing thereof.

FIG. 3 is a top perspective view of the header assembly 100 showing the nose cone 116 poised for coupling to the outer housing 110. At the rear 172 of the nose cone 116, the nose cone 116 includes a pocket 190 generally opposite the latch 176. The pocket 190 is configured to receive the secondary catch 146 or the primary catch 144, depending on the orientation of the nose cone 116 when loaded onto the outer contact 120. In the orientation shown in FIG. 3, the latch 176 is configured to engage the primary catch 144. The pocket 190 is configured to receive the secondary catch 146 (shown in FIG. 4). The pocket 190 provides clearance for the secondary catch 146 when the nose cone 116 is coupled to the outer housing 110. In an alternative embodiment, rather than using the pocket 190, the nose cone 116 may include two latches that are configured to engage the primary catch 144 and the secondary catch 146.

At the rear 172 of the nose cone 116, the nose cone 116 includes anti-rotation slots 192 that receive the anti-rotation rails 142 of the outer housing 110. The anti-rotation slots 192 are provided on opposite sides of the bore 174. In the illustrated embodiment, the anti-rotation slots 192 are positioned orthogonal with respect to the latch 176 and the pocket 190. For example, the latch 176 may be positioned at a 12 o'clock position, the pocket 190 may be positioned at a 6 o'clock position, and the anti-rotation slots 192 may be positioned at 3 and 9 o'clock positions. When the nose cone 116 is coupled to the outer housing 110, the anti-rotation slots 192 receive the anti-rotation rails 142. The anti-rotation slots 192 and the anti-rotation rails 142 hold a radial position of the nose cone 116 relative to the outer contact 120.

Figure 4:
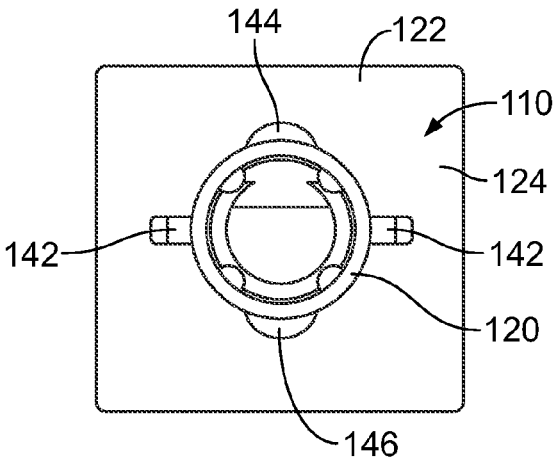
FIG. 4 is a front view of the outer housing.

FIG. 4 is a front view of the outer housing 110. The outer contact 120 extends forward from the front wall 124 of the rear shell 122. The anti-rotation rails 142 extend outward from the outer contact 120. In an exemplary embodiment, the anti-rotation rails 142 are orientated 180° with respect to one another. The primary catch 144 and the secondary catch 146 extend from the outer contact 120 in opposite directions. In an exemplary embodiment, the secondary catch 146 is oriented 180° with respect to the primary catch 144. The anti-rotation rails 142 are positioned generally orthogonal with respect to the catches 144, 146. In the illustrated embodiment, the primary catch 144 is positioned at a 12 o'clock position. The secondary catch 146 is positioned at a 6 o'clock position. The anti-rotation rails 142 are positioned at 3 and 9 o'clock positions.

The catches 144, 146 are identical to one another such that either the primary catch 144 or the secondary catch 146 may be used to retain the latch 176 (shown in FIG. 3) of the nose cone 116 (shown in FIG. 3). The anti-rotation rails 142 are positioned to allow the nose cone 116 to be mounted in either a normal orientation or an inverted orientation.

Figure 5:
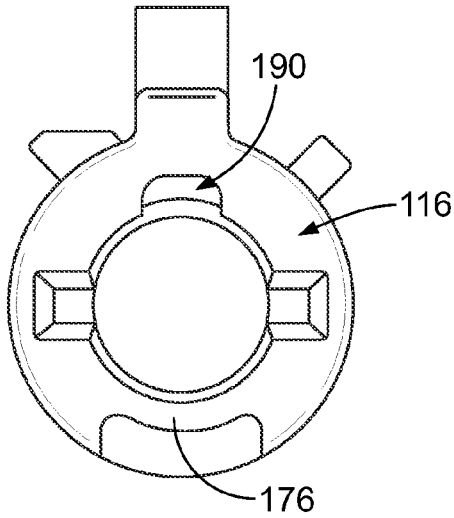
FIG. 5 is a rear view of the nose cone in a first orientation.

FIG. 5 is a rear view of the nose cone 116 oriented with the pocket 190 at a top and the latch 176 at a bottom. For example, the pocket 190 is positioned at a 12 o'clock position and the latch 176 is positioned at a 6 o'clock position. When the nose cone 116 is coupled to the outer housing 110 (shown in FIG. 4) in such orientation, the pocket 190 receives the primary catch 144 (shown in FIG. 4) and the latch 176 engages the secondary catch 146 (shown in FIG. 4).

Figure 6:
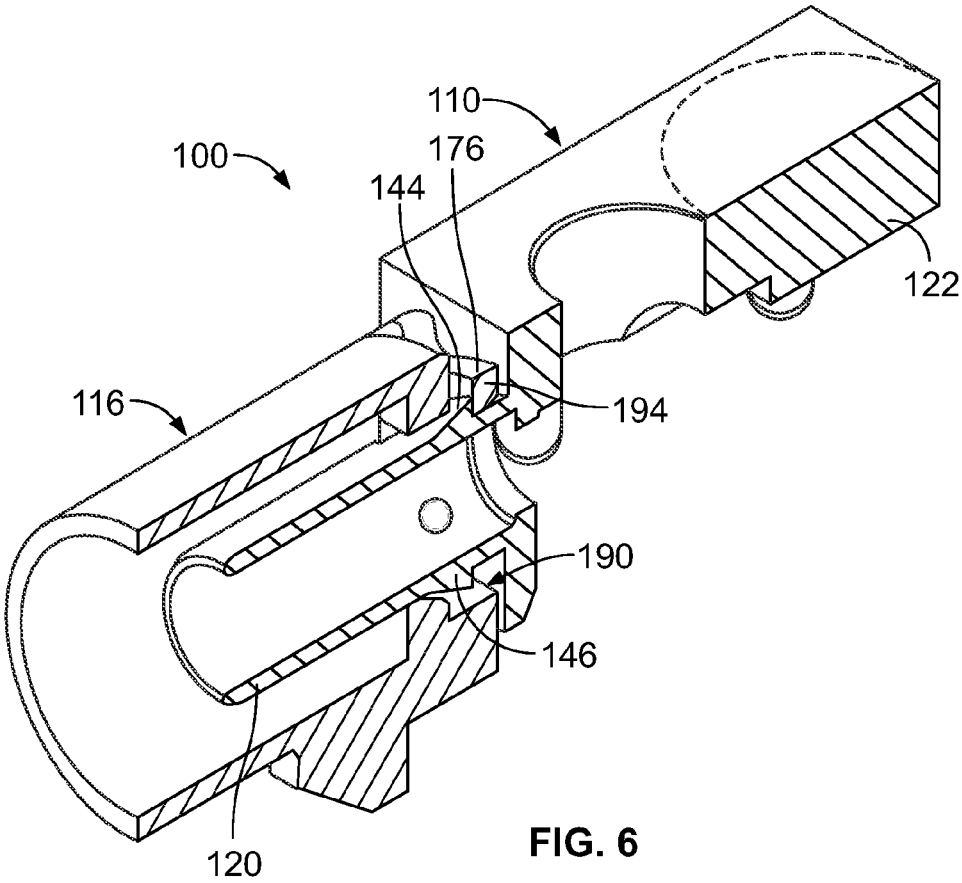
FIG. 6 is a front perspective, partial sectional view of the header assembly showing the nose cone coupled to the outer housing.
Figure 7:
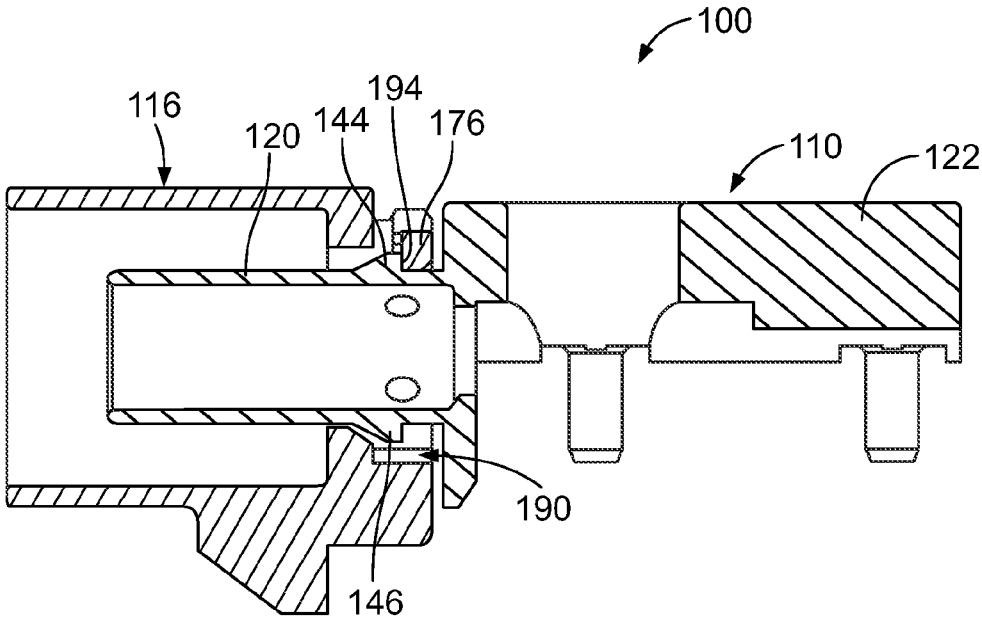
FIG. 7 is a side cross sectional view of the header assembly showing the nose cone coupled to the outer housing.

FIG. 6 is a front perspective, partial sectional view of the header assembly 100 showing the nose cone 116 coupled to the outer housing 110. FIG. 7 is a side cross sectional view of the header assembly 100 showing the nose cone 116 coupled to the outer housing 110. The nose cone 116 is loaded over the outer contact 120 toward the rear shell 122 until the latch 176 engages the corresponding catch 144.

In the illustrated embodiment, the latch 176 engages the primary catch 144. The latch 176 is captured behind a catch surface 194 of the catch 144 to secure the nose cone 116 to the outer housing 110. The latch 176 may be released by lifting the latch 176 over the catch 144 to remove the nose cone 116. The pocket 190 receives the secondary catch 146. The pocket 190 provides clearance within the nose cone 116 for the secondary catch 146.

In an exemplary embodiment, the nose cone 116 may be inverted or flipped 180° and coupled to the outer housing 110 such that the latch 176 engages the secondary catch 146. In such orientation, the pocket 190 receives the primary catch 144 and provides clearance in the nose cone 116 for the primary catch 144. Having two mating orientations for the nose cone 116 on the outer housing 110 provides different keying configurations for the header assembly 100 using the same outer housing 110 with the same nose cone 116.

In other alternative embodiments, the nose cone 116 may have more than two mating portions for providing a greater number of keying configurations. For example, rather than having ant-rotation rails 142 and anti-rotation slots 192, the outer housing 110 may include four orthogonally positioned catches and the nose cone 116 may include additional pockets or latches for accommodating the unlatched catches. The pockets may engage the catches by an interference fit to resist rotation of the nose cone 116 relative to the outer housing 110.

Figure 8:
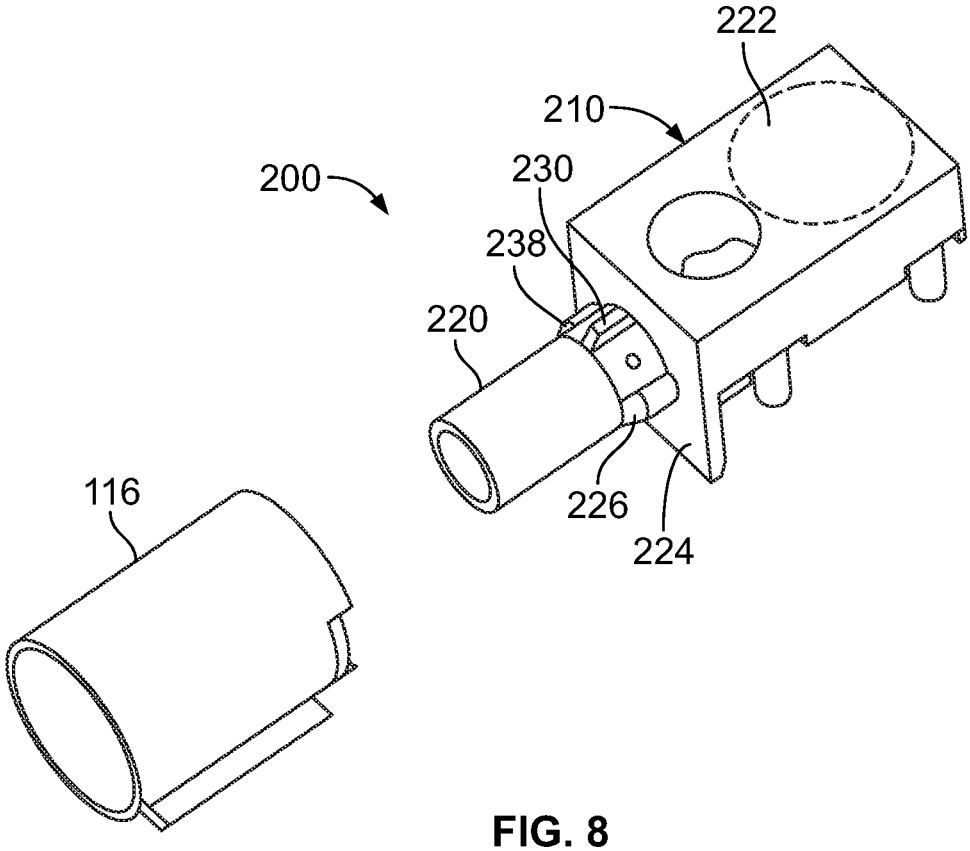
FIG. 8 is a front perspective view of a header assembly that includes an outer housing and the nose cone.
Figure 9:
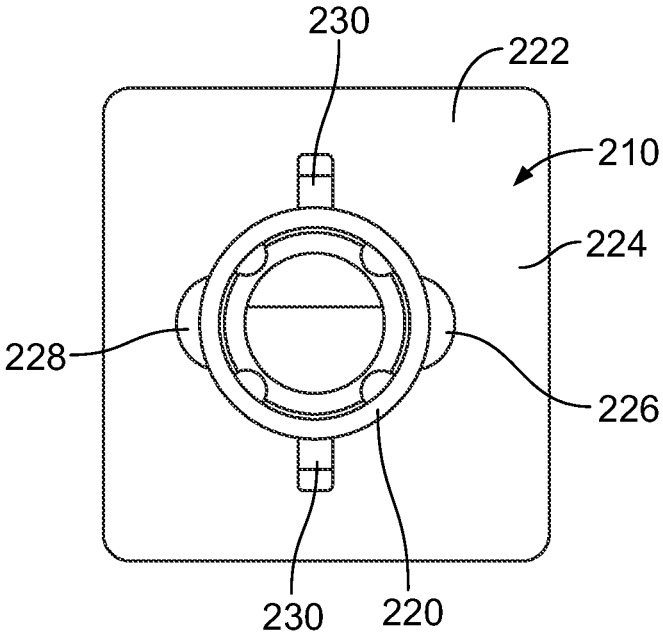
FIG. 9 is a front view of the outer housing shown in FIG. 8.
Figure 10:
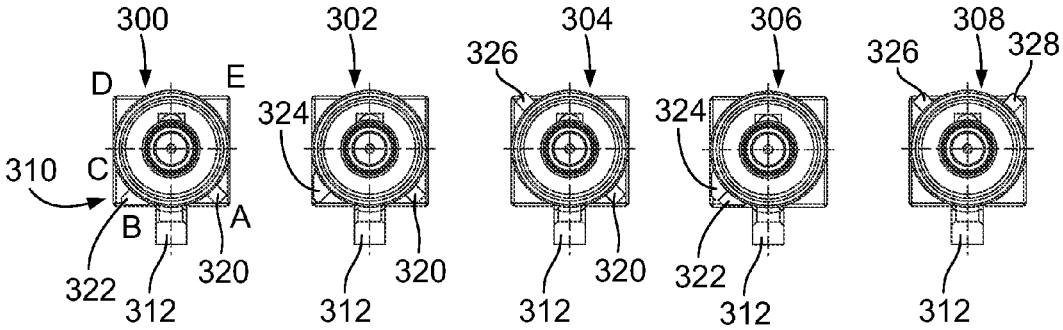
FIGS. 10-13 illustrate nose cones at different angular orientations relative to corresponding outer housings.

FIG. 8 is a front perspective view of a header assembly 200 that includes an outer housing 210 and the nose cone 116. FIG. 9 is a front view of the outer housing 210, formed in accordance with an exemplary embodiment. The outer housing 210 is similar to the outer housing 110 (shown in FIG. 2), however, the outer housing 210 has a different arrangement of catches and anti-rotation rails. The outer housing 210 includes an outer contact 220 and a rear shell 222. The outer contact 220 extends forward from a front wall 224 of the rear shell 222.

The outer housing 210 includes a primary catch 226 and a secondary catch 228 opposite the primary catch 226. The secondary catch 228 is positioned 180° with respect to the primary catch 226. In the illustrated embodiment, the primary catch 226 is positioned along a side of the outer contact 220, such as at a 3 o'clock position. The secondary catch 228 is positioned along a side of the outer contact 220, such as at a 9 o'clock position.

The outer housing 210 includes anti-rotation rails 230 extending along the outer contact 220. The anti-rotation rails 230 are positioned generally orthogonal with respect to the primary and secondary catches 226, 228. In the illustrated embodiment, the anti-rotation rails 230 are positioned at a 12 o'clock position and a 6 o'clock position.

With additional reference to FIG. 4, with exception of the positions of the catches 226, 228 and the anti-rotation rails 230, the outer housing 210 may be identical to the outer housing 110. In an exemplary embodiment, the catches 226, 228 are oriented 90° offset with respect to the orientation of the catches 144, 146 of the outer housing 110. The anti-rotation rails 230 are oriented at a 90° offset with respect to the anti-rotation rails 142. Having the catches 226, 228 at different angular positions than the catches 144, 146 allows the nose cone 116 to be coupled to the outer housing 210 at different angular orientations as compared to the outer housing 110. For example, the nose cone 116 may be coupled to the outer housing 210 at an angular position that is 90° or 270° as compared to the angular position of the mounting locations of the nose cone 116 on the outer housing 110.

FIGS. 10-13 illustrate a plurality of nose cones 300, 302, 304, 306, 308 at different angular orientations. The nose cones 300-308 each have a different combination of keying ribs 310. Each of the nose cones 300-308 include a mating latch 312 used to engage a corresponding mating latch of the mating electrical connector when matted thereto. In the illustrated embodiments, the keying ribs 310 are located at any of five different positions, designated at locations A, B, C, D and E, however other embodiments with other keying rib locations are possible. The keying ribs located at position A are designated as keying ribs 320. The keying ribs at position B are designated as keying ribs 322. The keying ribs at position C are designated as keying ribs 324. The keying ribs at position D are designated as keying ribs 326. The keying ribs at position E are designated as keying ribs 328.

In the illustrated embodiment, the nose cone 300 includes keying ribs 320, 322. The nose cone 302 includes keying ribs 320, 324. The nose cone 304 includes keying ribs 320, 326. The nose cone 306 includes keying ribs 322, 324. The nose cone 308 includes keying ribs 326, 328. Other combinations of the keying ribs 310 are possible in alternative embodiments, such as as set forth in SAE/USCAR-18 and DIN 72594-1.

With reference to FIGS. 10-13, different keying configurations are achieved by the nose cones 300-308 depending on the angular orientation of the nose cone 300-308. For example, any of the nose cones 300-308 may be mounted to either the outer housing 110 (shown in FIG. 4) or the outer housing 210 (shown in FIG. 9). As described above, the outer housing 110 is configured to accept the nose cone in different orientations (e.g. normal or inverted). Similarly, the outer housing 210 is configured to accept the nose cone in different orientations (e.g. normal or inverted).

With additional reference to FIGS. 4 and 9, the outer housings 110, 210 can be compared. The outer housing 110 defines a first outer housing and may be referred to as first outer housing 110. The outer housing 210 defines a second outer housing and may be referred to as a second outer housing 210. Components of the first outer housing 110 may be identified as "first" to differentiate from the second outer housing 210, the components of which may be identified as "second". Both the first and second outer housings 110, 210 are configured to receive the nose cone 116 or any of the nose cones 300-308. The first outer housing 110 has the first rear shell 130 and the first outer contact 120 extending forward from the first rear shell 130. The first outer contact 110 has a first catch 144 extending therefrom positioned forward of the first rear shell 130. The first catch 144 is located at a first radial position along the first outer contact 120. The second outer housing 210 has a second rear shell 222 and a second outer contact 220 extending forward from the second rear shell 222. The second outer contact 210 has the second catch 226 extending therefrom positioned forward of the second rear shell 222. The second catch 226 is located at a second radial position along the second outer contact 210 different than the first radial position. The nose cone 116 has the latch 176 configured to engage the first catch 144 when the nose cone 116 is coupled to the first outer contact 120 and configured to engage the second catch 226 when the nose cone 116 is coupled to the second outer contact 220. The orientation of the keying ribs 118 is different when the nose cone 116 is coupled to the first outer contact 120 as compared to when the nose cone 116 is coupled to the second outer contact 220.

Figure 11:
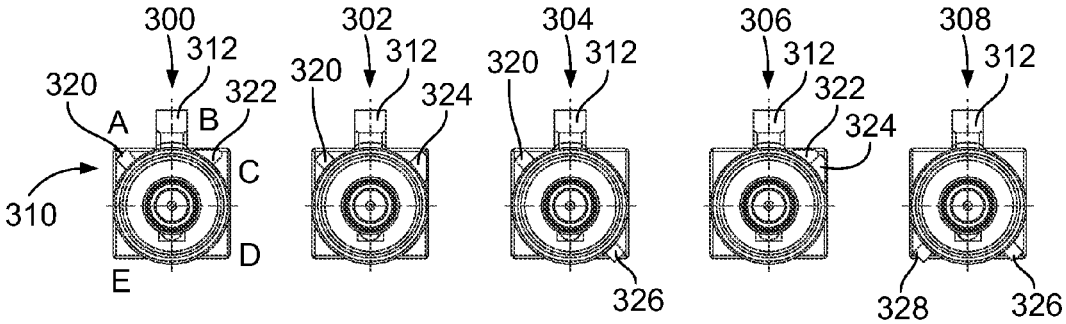
Figure 12:
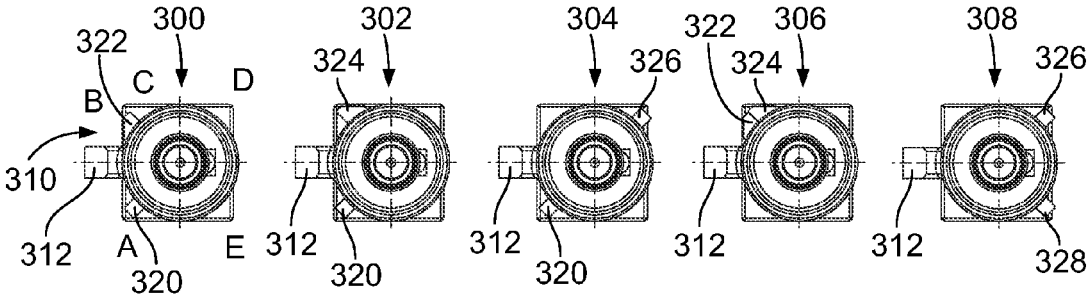
Figure 13:
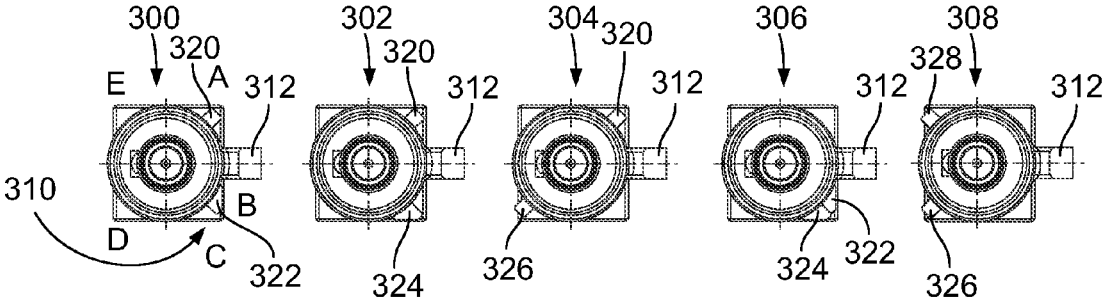

Turning additionally to FIGS. 10-13, FIG. 10 illustrates the nose cones 300-308 as mounted to the outer housing 110 in normal orientations. FIG. 11 illustrates the nose cones 300-308 as coupled to the outer hosing 110 in inverted orientations. FIG. 12 illustrates the nose cones 300-308 as coupled to the outer housing 210 in normal orientations. FIG. 13 illustrates the nose cones 300-308 as mounted to the outer housing 210 in inverted orientations. In the normal orientations, the nose cones 300-308 are mounted to the outer housings 110, 210 with the corresponding latch engaging the primary catch 144, 226, respectively. In the inverted orientations, the nose cones 300, 308 are mounted to the outer housing 110, 210 with the corresponding latches engaging the secondary catches 146, 228, respectively.

The product family defined using the outer housings 110, 210 and the nose cones 300-308 achieve twenty distinct keying configurations using only seven parts. Manufacture of the seven parts is less expensive than manufacturing twenty discrete parts. For example, tooling cost may be reduced when manufacturing less part numbers. Additionally, the product family includes only two die cast parts, namely the outer housings 110, 210, with five plastic injection molded parts, namely the nose cones 300-308. Tooling and manufacturing cost of the product family is greatly reduced with two die cast parts and five plastic injection molded parts, as compared to a product family having twenty discrete die cast components to achieve the twenty keying configures. Optionally, the two outer housings 110, 210 may be manufactured from the same formed metal piece (e.g. die cast mold), by using different interchangeable tooling to change the locations of the catches and the rails. Similarly, the nose cones 300-308 may be formed using a single mold with different interchangeable tooling to change the location of the keying ribs.

The product family may be packaged and sold as a kit including the first and second outer housing 110, 210, along with any number of the nose cones 300-308. The customer uses the kit to mix and match the outer housing(s) and nose cone(s) to achieve desired keying configurations for the header assembly. Each nose cone 300-308 may be coupled to the outer housing 110 in a normal orientation or an inverted orientation and each nose cone 300-308 may be coupled to the outer housing 210 in a normal orientation or an inverted orientation, thus achieving four different keying configurations for each nose cone 300-308. Other product families may include other combinations of components, such as only a single outer housing that allows for normal and inverted mounting (or other orientations) of the nose cones thereto. Other types of nose cones may be provided having different keying configurations.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means plus-function format and are not intended to be interpreted based on 35 U.S.C. §112, sixth paragraph, unless and until such claim limitations expressly use the phrase "means for" followed by a statement of function void of further structure.

What is claimed is:

1. A header assembly comprising:

a center contact;

a dielectric body surrounding the center contact;

an outer housing holding the center contact and the dielectric body, the outer housing being conductive and providing electrical shielding for the center contact, the outer housing having a rear shell and an outer contact extending forward from the rear shell, the outer contact having a catch extending therefrom positioned forward of the rear shell, the outer contact receiving the dielectric body and the center contact; and a nose cone coupled to the outer contact, the nose cone being manufactured from a non-conductive material, the nose cone surrounding the outer contact, the nose cone having keying ribs along an exterior thereof, the nose cone having a latch engaging the catch to secure the nose cone to the outer housing.

2. The header assembly of claim 1, wherein the nose cone is removably coupled to the outer contact.

3. The header assembly of claim 1, wherein the nose cone is variably positionable on the outer contact at at least two different radial positions.

4. The header assembly of claim 1, wherein the catch is a primary catch, the outer contact having a secondary catch opposite primary catch, the nose cone being coupled to either the primary catch or the secondary catch to change an orientation of the keying ribs relative to the outer housing.

5. The header assembly of claim 1, wherein the outer housing includes anti-rotation rails extending along an exterior of the outer contact, the nose cone comprising anti-rotation slots receiving the anti-rotation rails when the nose cone is coupled to the outer contact, the anti-rotation rails and anti-rotation slots hold a radial position of the nose cone relative to the outer contact.

6. The header assembly of claim 1, wherein the nose cone includes a pocket opposite the latch, the nose cone being positionable on the outer contact in different orientations, wherein, in a first orientation of the nose cone, the latch engages the catch, and wherein in a second orientation of the nose cone, the pocket receives the catch.

7. The header assembly of claim 1, wherein the rear shell is generally box-shaped and includes a front wall, the outer contact being cylindrical and extending forward of the front wall.

8. The header assembly of claim 1, wherein the rear shell is generally box-shaped and includes a front wall, a top wall, and a bottom configured to be mounted to a circuit board, the nose cone being variably positionable relative to the outer housing to change the orientation of the keying ribs relative to the top wall and bottom.

9. The header assembly of claim 1, further comprising a shield member positioned between the nose cone and the rear shell, the shield member having deflectable shield fingers configured to engage a grounded electronic component, the shield member being electrically connected to the outer housing to create a ground path between the outer housing and the grounded electronic component.

10. A header assembly comprising:

a center contact;

a dielectric body surrounding the center contact;

an outer housing holding the center contact and the dielectric body, the outer housing being conductive and providing electrical shielding for the center contact, the outer housing having a rear shell and an outer contact extending forward from the rear shell, the outer contact receiving the dielectric body and the center contact, the outer contact having a primary catch extending therefrom positioned forward of the rear shell, the outer contact having a secondary catch extending therefrom positioned forward of the rear shell and located 180° from the primary catch; and a nose cone coupled to the outer contact, the nose cone being manufactured from a non-conductive material, the nose cone surrounding the outer contact, the nose cone having keying ribs along an exterior thereof, the nose cone having a latch and a pocket located 180° from the latch, the nose cone being positioned in one of a primary orientation and a secondary orientation, wherein, in the primary orientation, the latch engages the primary catch to secure the nose cone to the outer housing with the pocket receiving the secondary catch, and wherein, in the secondary orientation, the latch engages the secondary catch to secure the nose cone to the outer housing with the pocket receiving the primary catch.

11. The header assembly of claim 10, wherein the primary catch and the secondary catch are located at 12 o'clock and 6 o'clock positions, respectively.

12. The header assembly of claim 10, wherein the primary catch and the secondary catch are located at 3 o'clock and 9 o'clock positions, respectively.

13. The header assembly of claim 10, wherein the outer housing includes anti-rotation rails extending along an exterior of the outer contact, the nose cone comprising anti-rotation slots receiving the anti-rotation rails, wherein, when the nose cone is coupled to the outer contact, the anti-rotation rails and anti-rotation slots hold a radial position of the nose cone relative to the outer contact.

14. The header assembly of claim 10, wherein the rear shell is generally box-shaped and includes a front wall, a top wall, and a bottom configured to be mounted to a circuit board, the keying ribs being oriented in a first orientation relative to the top wall and the bottom when the nose cone is coupled to the outer housing in the primary orientation, the keying ribs being positioned in a different, second orientation relative to the top wall and the bottom when the nose cone is coupled to the outer housing in the second orientation.

15. The header assembly of claim 10, further comprising a shield member positioned between the nose cone and the rear shell, the shield member having deflectable shield fingers configured to engage a grounded electronic component, the shield member being electrically connected to the outer housing to create a ground path between the outer housing and the grounded electronic component.

16. A header assembly kit comprising:

a center contact;

a dielectric body configured to receive the center contact;

a first outer housing configured to receive the dielectric body, the first outer housing being conductive to provide electrical shielding for the center contact, the first outer housing having a first rear shell and a first outer contact extending forward from the first rear shell, the first outer contact having a first catch extending therefrom positioned forward of the first rear shell, the first catch being located at a first radial position along the first outer contact;

a second outer housing configured to receive the dielectric body, the second outer housing being conductive to provide electrical shielding for the center contact, the second outer housing having a second rear shell and a second outer contact extending forward from the second rear shell, the second outer contact having a second catch extending therefrom positioned forward of the second rear shell, the second catch being located at a second radial position along the second outer contact, the second radial position being different than the first radial position; and a nose cone configured to be coupled to either the first outer contact or the second outer contact, the nose cone being manufactured from a non-conductive material, the nose cone having keying ribs along an exterior thereof, the nose cone having a latch, the latch being configured to engage the first catch when the nose cone is coupled to the first outer contact, the latch being configured to engage the second catch when the nose cone is coupled to the second outer contact, wherein the orientation of the keying ribs is different when the nose cone is coupled to the first outer contact as compared to when the nose cone is coupled to the second outer contact.

17. The header assembly kit of claim 16, wherein the first catch is positioned at a 12 o'clock position and the second catch is positioned at a 3 o'clock position, the nose cone being oriented at orthogonal positions when coupled to the first outer housing compared to the second outer housing.

18. The header assembly kit of claim 16, wherein the first rear shell is generally box-shaped and includes a front wall, a top wall, and a bottom configured to be mounted to a circuit board, the second rear shell being generally box-shaped configured to be mounted to the circuit board, the nose cone being coupled to either the first outer housing or the second outer housing such that the keying ribs are oriented at different angular orientations relative to the circuit board.

19. The header assembly kit of claim 16, wherein the first catch comprises a first primary catch, the first outer housing comprising a first secondary catch opposite the first primary catch, wherein the second catch comprises a second primary catch, the second outer housing comprising a second secondary catch opposite the second primary catch, the nose cone being configured to be coupled to either the first outer housing or the second outer housing in one of four distinct orthogonal angular orientations by coupling the latch to either the first primary catch, the first secondary catch, the second primary catch or the second secondary catch.

20. The header assembly kit of claim 19, wherein the first primary catch is positioned at a 12 o'clock position and the first secondary catch is positioned at a 6 o'clock position, the first outer housing comprising anti-rotation rails extending along an exterior of the first outer contact, the anti-rotation rails being positioned at a 3 o'clock position and a 9 o'clock position, and wherein the second primary catch is positioned at a 3 o'clock position and the second secondary catch is positioned at a 9 o'clock position, the second outer housing comprising anti-rotation rails extending along an exterior of the second outer contact, the anti-rotation rails of the second outer housing being positioned at a 12 o'clock position and a 6 o'clock position, the nose cone comprising anti-rotation slots that receive corresponding anti-rotation rails when the nose cone is coupled to either the first outer contact or the second outer contact.

* * * * *